US005573323A

United States Patent [19]

Kim et al.

[11] Patent Number: 5,573,323

[45] Date of Patent: Nov. 12, 1996

[54] REFRIGERATOR HAVING A PRESSURE EQUILBRIUM APPARATUS

[75] Inventors: Myoung W. Kim, Seoul; Hyo S. Kang, Suwon; Suk Bang, Kyungki-do, all of Rep. of Korea

[73] Assignee: Samsung Electronics Co., Ltd., Suwon, Rep. of Korea

[21] Appl. No.: 343,906

[22] Filed: Nov. 18, 1994

[30] Foreign Application Priority Data

| | | | |
|---|---|---|---|
| Nov. 30, 1993 | [KR] | Rep. of Korea | UM93-25779 |
| Feb. 4, 1994 | [KR] | Rep. of Korea | UM94-2166 |
| Feb. 4, 1994 | [KR] | Rep. of Korea | UM94-2169 |

[51] Int. Cl.[6] ..... A47B 91/00

[52] U.S. Cl. ..... 312/405; 454/195

[58] Field of Search ..... 312/401, 405; 454/195, 358

[56] References Cited

U.S. PATENT DOCUMENTS

| | | | |
|---|---|---|---|
| 965,473 | 7/1910 | Lutz | 312/401 |
| 2,871,523 | 2/1959 | Negoro | 454/195 |
| 4,932,730 | 6/1990 | Zeismann et al. . | |

FOREIGN PATENT DOCUMENTS

| | | | |
|---|---|---|---|
| 3250138 | 11/1991 | Japan | 454/195 |
| 89/3103 | 5/1989 | Rep. of Korea . | |

*Primary Examiner*—Jose V. Chen
*Assistant Examiner*—Gerald A. Anderson
*Attorney, Agent, or Firm*—Burns, Doane, Swecker & Mathis, L.L.P.

[57] ABSTRACT

When a door of a refrigerator door is closed, there is provided a passage which remains open to communicate the interior of the refrigerator with air outside of the refrigerator for a predetermined time period in order to enable pressures inside and outside of the refrigerator to be equalized. Thus, the door can be subsequently opened more easily. Energy for closing the passage after the predetermined time period is stored by an energy storing member in response to either a door-opening movement or a door-closing movement.

20 Claims, 7 Drawing Sheets

REFRIGERATOR HAVING A PRESSURE EQUILBRIUM APPARATUS

BACKGROUND OF THE INVENTION

This invention relates to a refrigerator having a pressure equilibrium apparatus, more particularly to a refrigerator having a pressure equilibrium apparatus which equalizes pressure inside and outside of the refrigerator to facilitate a subsequent opening of the refrigerator door.

A conventional refrigerator comprises a cabinet which forms a body, and door(s) which is/are hingedly mounted at the front side of the cabinet. Further, a gasket having a magnet therein is provided at the door for sealing the gap between the door and the cabinet. After the door is closed, a cooling fan adjacent to an evaporator is operated to pull the inside air of the compartment toward the evaporator. Because the exchanged air is at a lower temperature, the pressure of the air is relatively lowered. That creates a pseudo vacuum in the inside of the compartment. Owing to the pressure difference inside and outside of the compartment additional force corresponding to the pressure difference is required to open the door, which is one problem of the conventional refrigerator.

Meanwhile, the door opening apparatus of a refrigerator, which is operated by foot, is described in Korean Utility Model Publication No.1989 - 3103. In Fig.10 herein, a pushing bar 2 is provided with its lower portion hinged by shaft 3, in the side wall 1 of the refrigerator. The lower end 3" of the pushing bar 2 supported by the spring 5 is fitted in the fixing portion 7 formed under the footing 6. The upper end 3' of the pushing bar 2 pushes the gasket 4' of the door 4 to open the door. However, a spacious volume is lost due to the necessity to provide the apparatus in the lower portion of the refrigerator. During production the installation of many parts is required and that increases the manufacturing steps.

Further, another conventional apparatus for opening the door without additional force is described in U.S. Pat. No. 4,932,730. The apparatus eliminates the difference between the indoor and the outdoor pressure. To open the door, a user grips the latch of the door and the lip of the latch lifts away a portion of the gasket from the contact strip to form an opening. Through the opening the outside air flows into the inside of the refrigerator. That achieves the pressure balance outside and inside of the refrigerator, thereby permitting ease for opening the door. However, the apparatus still has a danger of breaking the gasket by the lip of the latch, and requires additional force for operating the latch to open the door which gives an inconvenience to the user.

SUMMARY OF THE INVENTION

An object of the present invention is to provide a refrigerator having a pressure equilibrium apparatus which can use energy generated by the closing or opening of the door to maintain a pressure equilibrium inside and outside of the refrigerator after closing the door, so that the door can be subsequently opened without difficulty.

According to the present invention, a pressure equilibrium apparatus comprises a transmitting means for transmitting energy generated from an opening of a door, an air inflowing means for making an air inflowing opening by operation of the transmitting means, and a releasing means for using the transmitted energy after the closing of the door to close the opening.

Further, the transmitting means comprises a gasket housing a magnet, and a magnetic plate.

Further, the air inflowing means comprises an air inflowing opening which is formed against the gasket of the door.

Furthermore, the releasing means comprises an one-end open cylinder, and a piston having an air inflowing aperture and an air outflowing aperture.

Otherwise, the transmitting means comprises a wire connected to a hinge pin protruding from the door.

Further, the air inflowing means comprises an air inflowing opening which is penetrated at a side wall of the refrigerator, said wall providing a hinged door thereat.

Furthermore, the releasing means comprises a valve which is opened as a receiving of the energy and is closed as a releasing of the energy, and an orifice which discharges the fluid as a releasing of the energy.

Otherwise, the transmitting means comprises a rod which is freely hinged at an opening of the door and is forcedly hinged against the door at a closure of the door.

Further, the air inflowing means comprises an air shutdown member connected hingedly to the wall of the refrigerator and contacted partially at the gasket of the door.

Furthermore, the releasing means comprises a spiral torsion spring which holds the transmitted energy, and gear train provided between the transmitting means and the torsion spring.

In this structure, when the door is opened, the magnetic plate is pulled out being attached to the gasket of the door. When the door is closed, the outside air inflows through the opening which is formed by the extracted magnetic plate. Next, the air in the cylinder is discharged through the air ouflowing opening of the piston and thus the magnetic plate is retracted to its original position to close the opening which is formed by the extracted magnetic plate. Thus, the pressure difference between the outside and the inside of the compartment can be solved.

The apparatus of the present invention utilizes the energy which is generated from the opening/closure of the door to form the outside air inflowing passage, and the passage is gradually closed so that the energy is gradually released. Thus, no individual apparatus and additional force are needed.

DESCRIPTION OF THE PREFERRED EMBODIMENTS

Figure 1:
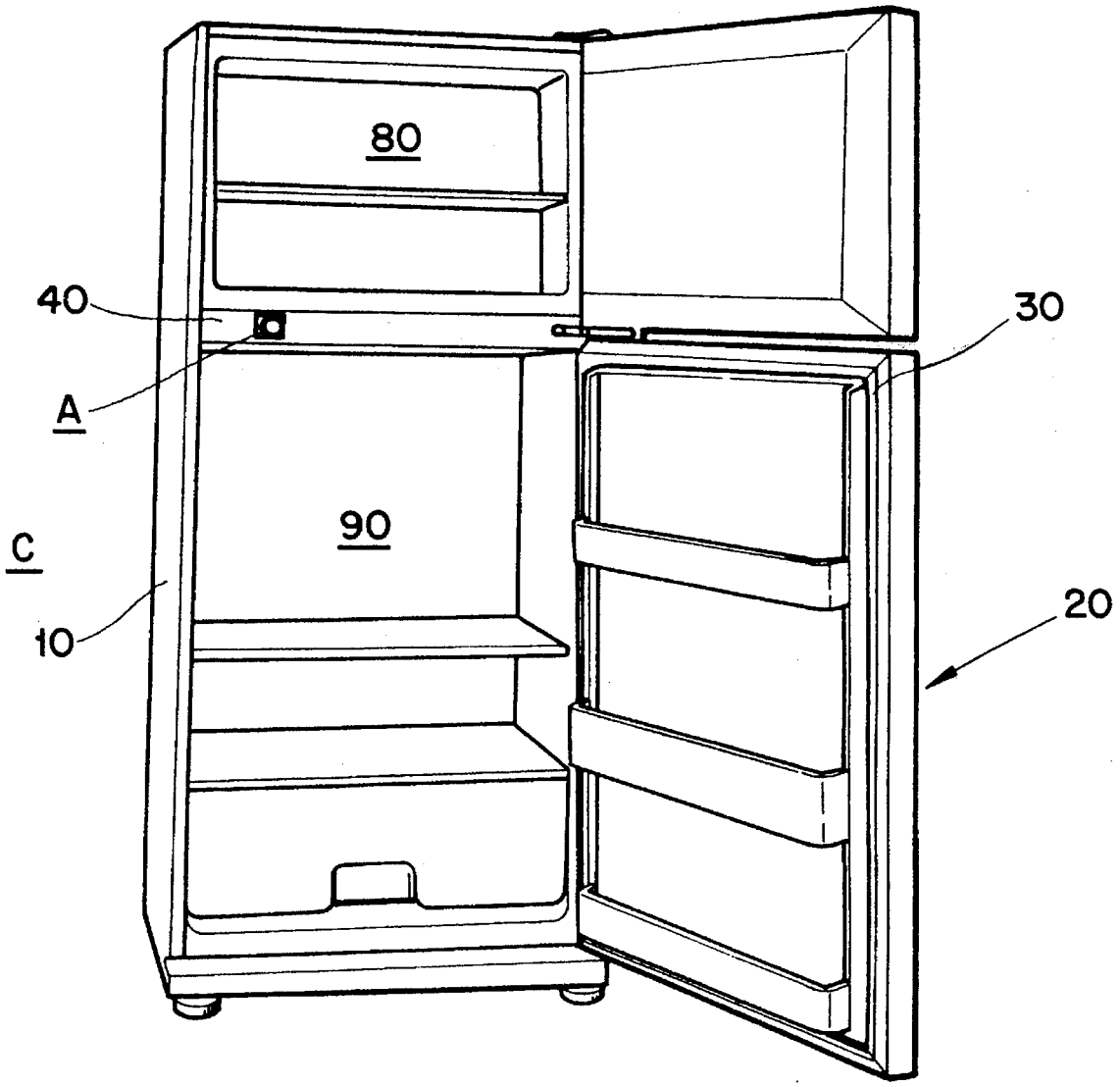
Fig. 1 is a perspective view of a refrigerator having a pressure equilibrium apparatus according to a first embodiment of the present invention.
Figure 2:
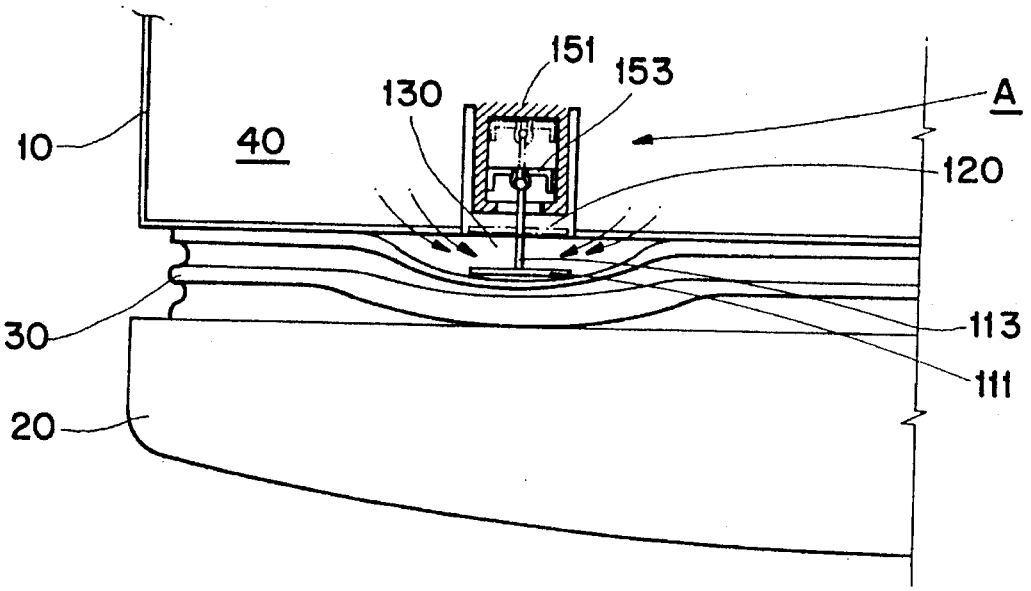
Fig. 2 is a plan view, partially cut away, of the refrigerator of FIG. 1 immediately after the door has been closed.

A first embodiment of the present invention will be described in FIGS. 1 to 4. The refrigerator adapting a pressure equilibrium apparatus. The is shown in FIGS. 1 and 2. A refrigerator comprises a cabinet 10 which forms a body, and door 20 which is hingedly mounted at the front side of the cabinet 10. Further, a gasket 30 having a magnet (not shown) therein is provided at the door 20 for sealing a gap between the door 20 and the cabinet 10. An intermediate partition 40 is provided to divide the interior of the refrigerator into a freezing chamber 80 and a refrigerating chamber 90. The pressure equilibrium apparatus A is provided at the front of the intermediate partition 40 facing the gasket 30.

Figure 3:
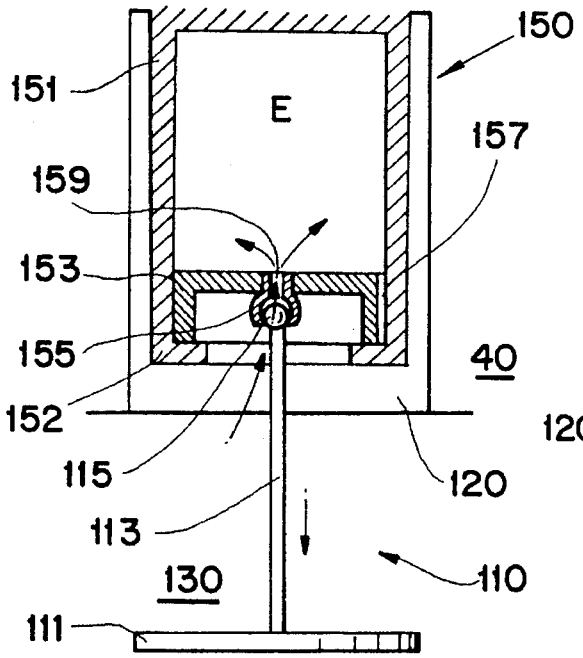
FIG. 3 is an enlarged plan view of a pressure equilibrium apparatus while the refrigerator door is being opened.

The pressure equilibrium apparatus A comprises (a) transmitting means 110 for transmitting energy generated by the step of opening door 20 as shown in FIG. 3, (b) an air inflowing means or a space 130 for guiding the flow of the outside air (i.e., air located outside of the refrigerator) into the inside of the refrigerator, and (c) a releasing means 150 for releasing the stored energy transmitted by the transmitting means 110.

The transmitting means 110 comprises a magnetic plate 111 which is attracted to a magnet 111A housed in the gasket 30, and a rod 113 provided at the rear face of the magnetic plate 111 and extended along the longitudinal direction of the releasing means 150 described later. Further, another end of the rod 113 has a ball 115.

The air inflowing means 130 comprises a passage of space which is temporarily formed in the gasket 30 by the plate 111 after the door has been closed and before the gasket 30 has pushed the plate into the bore 120.

The releasing means 150 comprises a cylinder 151 provided in a bore 120 of the intermediate partition 40, and a piston 153 assembled slidingly in the cylinder 151 and being reciprocated by the rod 113. Further, one end of the cylinder 151 is opened to intercommunicate with the outside air, and that open end has an inwardly projecting flange 152 to prevent the piston 153 from coming out of the cylinder 151. The piston 153 comprises a spherical seat 155 formed at the center thereof to receive the ball 115 of the rod 113, and an air inlet aperture 159 formed at the center of the seat 155. The outside air can inflow into the space E formed between the piston 153 and the cylinder 151 through the aperture 159.

The spherical seat 155 covers over the ball 115 such that the ball 115 can open/close the aperture 159. The seat 155 is made with an elasticity, so that a gap is formed between the ball 115 and the aperture 159 when the ball 115 uncovers the aperture 159, that is, when the rod 113 is pulled. The outside air flows via the gap and the aperture 159 into the space E. The surface of the ball 115 is formed so that the air is permitted to inflow through the gap between the ball 115 and the aperture 159. In the circumference of the piston 153, that is, the portion making contact with the inner wall of the cylinder 151 there is provided an air outlet aperture 157, through which the air of the space E comes out.

The pressure equilibrium apparatus of the refrigerator built as described above is operated as follows. Firstly, the door opening procedure is described referring to FIG. 3. When the door is being opened, the magnetic plate 111, attracted to the magnet, is extracted by the magnetic force of the magnet housed in the gasket 30 and thus the bore 120 becomes opened. As the plate 111 comes out it pulls the rod 113, so that a gap is formed between the ball 115 and the aperture 159. The outside air flows into the space E through the gap. Additionally, the outside air can flow into the space E through the aperture 157. During the opening of the door the piston 153 to contacts to the flange 152, and thus the magnet plate 111 is separated from the gasket 130. The door thereafter becomes opened.

Figure 4:
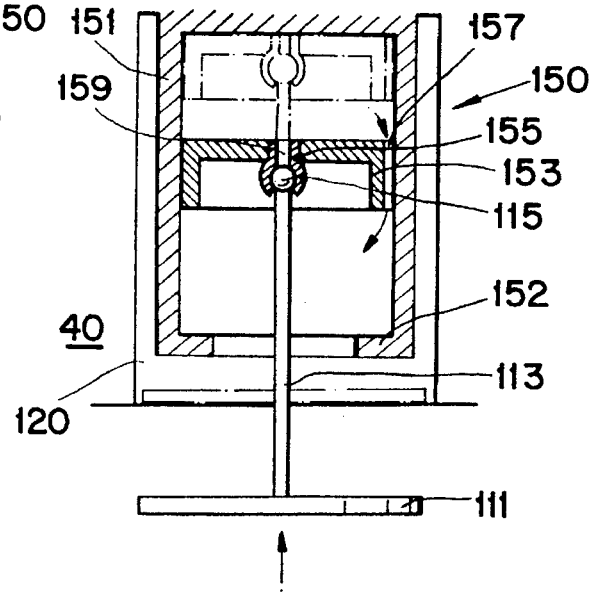
FIG. 4 is an enlarged plan view of a pressure equilibrium apparatus immediately after refrigerator door has been closed and a piston of the pressure equilibrium apparatus is being pushed in by a resilient gasket toward a position shown in phantom lines.

Next, the door closure procedure is described referring to FIG. 4. At the instant the door becomes closed, the gasket 30 goes to the front edge of the cabinet 10 as shown in FIG. 3. At this time, since the magnet plate 111 is off set outwardly from the front edge of the cabinet 10, gasket 30 is compressed (stores energy) whereby the gap or the air inflowing passage 130 is formed between the gasket 30 and the cabinet 10. Simultaneously, the ball 115 formed at the one end of the rod 113 covers the aperture 159 of the piston 153. Then the resilient gasket begins to push the plate 111 and piston 153 inwardly, and the aperture 157 permits gradual outflow of the air contained in the space E of the cylinder 15 as shown in FIG. 4. This occurs for a predetermined time lag (4 to 7 second in this embodiment), during which period the air inflowing passage 130 remains formed between the cabinet 10 and the gasket 30 of the door 20. As the outside air flows to the inside of the cabinet through the air inflowing passage 130 due to the pressure difference generated after closing the door, the pressure inside and outside of the cabinet is equalized, thereby permitting an easy subsequent opening of the door.

Figure 5:
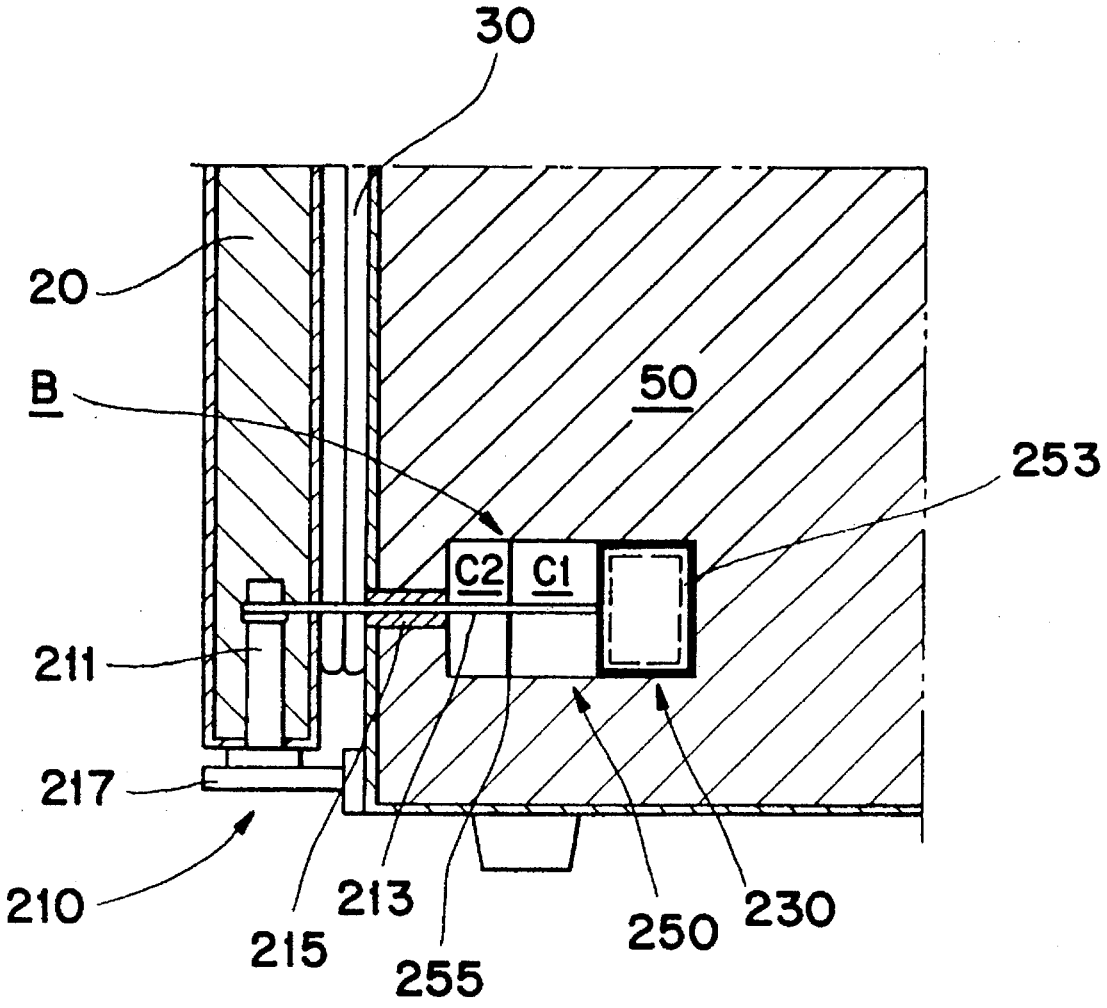
FIG. 5 is a side view, partially cut away, of a refrigerator having a pressure equilibrium apparatus according to a second embodiment of the present invention.
Figure 6:
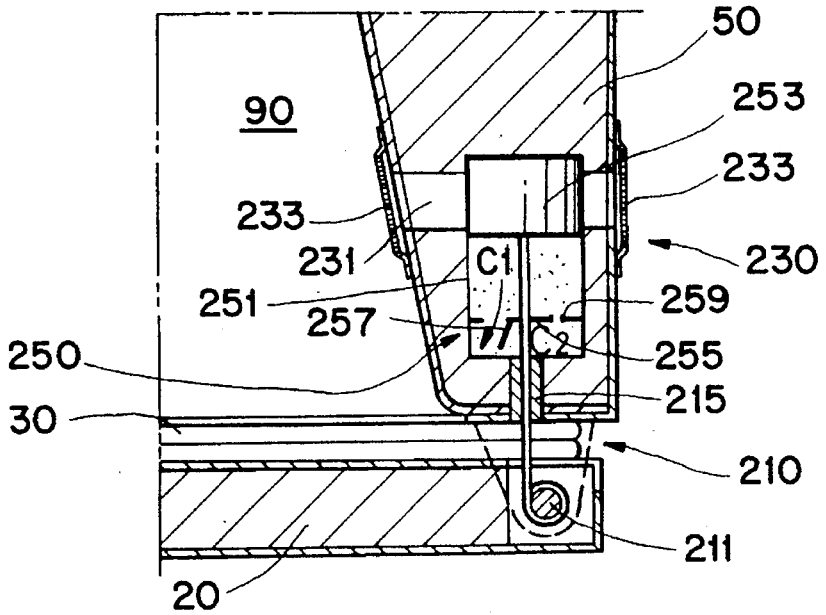
FIG. 6 is an enlarged plan view, partially cut away, of a pressure equilibrium apparatus with door closed in FIG. 5.
Figure 7:
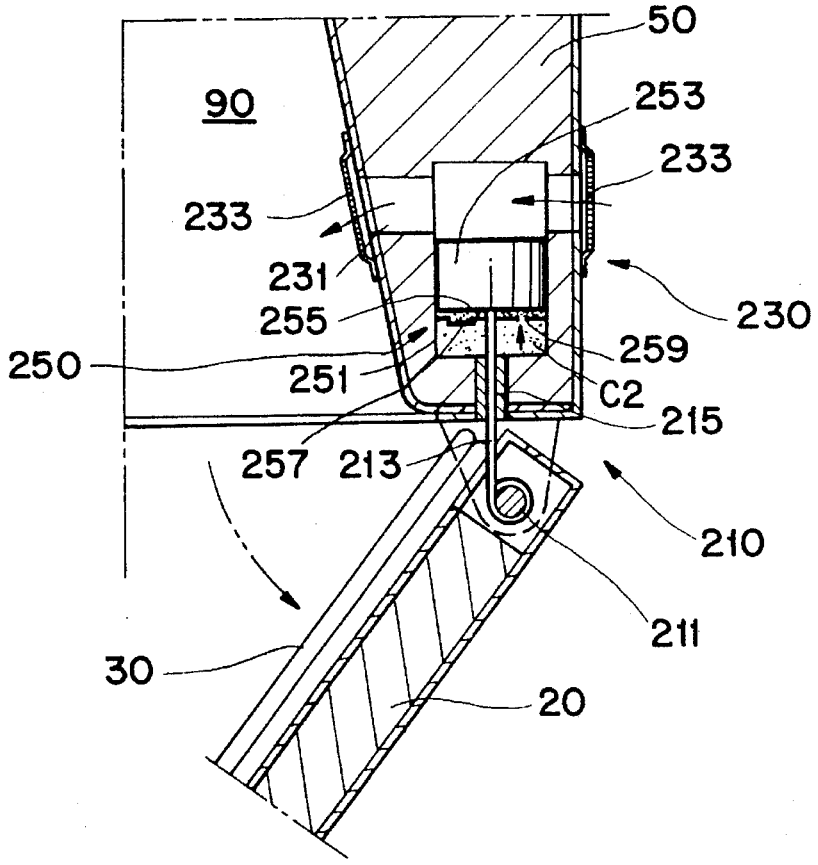
FIG. 7 is an enlarged plane view, partially cut away, of a pressure equilibrium apparatus with door opened in FIG. 5.

A second embodiment of the present invention will be described in connection with FIGS. 5 to 7. FIG. 5 shows a pressure equilibrium apparatus B mounted in the side wall of the refrigerator. FIG. 6 illustrates the operation of the pressure equilibrium apparatus B when the door is closed, whereas FIG. 7 illustrates the operation of the pressure equilibrium apparatus B when the door is open. The same parts as that of the first embodiment are designated by the same numerals but the detailed description of those parts will be omitted. The pressure equilibrium apparatus B is mounted in the side wall 50 adjacent the edge thereof where the door 20 is hinged.

The pressure equilibrium apparatus B comprises (a) transmitting means 210 for transmitting energy generated by the opening of a door 20, (b) an air inflowing means 230 for guiding the flow of the outside air into the inside of the refrigerator, and (c) a releasing means 250 for releasing the stored energy transmitted by the transmitting means 210.

The transmitting means 210 comprises a hinge pin 211 oriental perpendicularly on a hinge member 217 extending from the side wall 50 for hingedly mounting the door 20, and a wire 213 connected to the releasing means 250 for being wound on the hinge pin 211. Further, the wire 213 passes through mounted in a bushing 215 of the side wall 50 for preventing the outflow of fluid contained in the releasing means 250.

The air inflowing means 230 comprises an air inflowing opening or passage 231 (see FIG. 6) extending tranversely through the side wall 50 for allowing the outside air to inflow, and filters 233 covering the inlet and the outlet of the opening 231 for preventing dust from inflowing and the inside air from outflowing.

The releasing means 250 comprises a fluid-containing cylinder 251 having an pen end connected to the opening 231, an intermediate wall 255 mounted adjacent to a closed end of the cylinder 251, and a piston 253 housed in the cylinder 251 and reciprocated between the opening 231 and the intermediate wall 255.

When the fluid of the cylinder 251 is in a neutral state (FIG. 6), a space or chamber C1 bordered by the piston 253 and the intermediate wall 255 has more volume than a space or chamber C2 bordered by the intermediate wall 255 and the closed end of the cylinder 251. When the fluid is fully compressed FIG. 7, the space C2 contains highly compressed fluid.

Furthermore, the intermediate wall 255 has a valve 257 and an orifice 259. During the fluid compressed cycle of the piston 253, the fluid of the space C1 flows into the space C2 through the valve 257, whereas when the expansion cycle of the piston 253, the fluid of the space C2 discharges to the space C1 through the orifice 259 with the valve 257 being closed.

The pressure equilibrium apparatus of the refrigerator built as described above is operated as follows. In the closed state of the door 20 shown in FIG. 6, the piston 253 closes the opening 251 by the expansion force of the fluid which is contained in the cylinder 251 with a precompressed force. That prevents the inside air from flowing out to the outside. If the door 20 is opened as shown in FIG. 7, the hinge pin 211 is rotated and one end of the wire 213 is gradually wound on the pin 211. The other end of the wire 213 pulls the piston 231 toward the space C2. The piston 253 pushes the fluid of the space C1 into the space C2 through the opened valve 257. The fluid of the space C2 is thus compressed. Simultaneously, the piston 253 moves from the opening 231 into the cylinder 251 and the opening 231 becomes unblocked.

Next, when the door 20 is closed, the compressed fluid of the space C2 expands into the space C1 through the orifice 259. The expanding fluid gradually pushes the piston 253. During the resulting predetermined time lag (4 to 7 second in this embodiment), the air inflowing opening 231 remains open. Accordingly, the outside flows to the inside of the cabinet through the air inflowing opening 231 due to the pressure difference generated after closing the door. As a result, the pressure inside and outside of the cabinet is equalized, thereby providing for an easier subsequent opening of the door.

Figure 8:
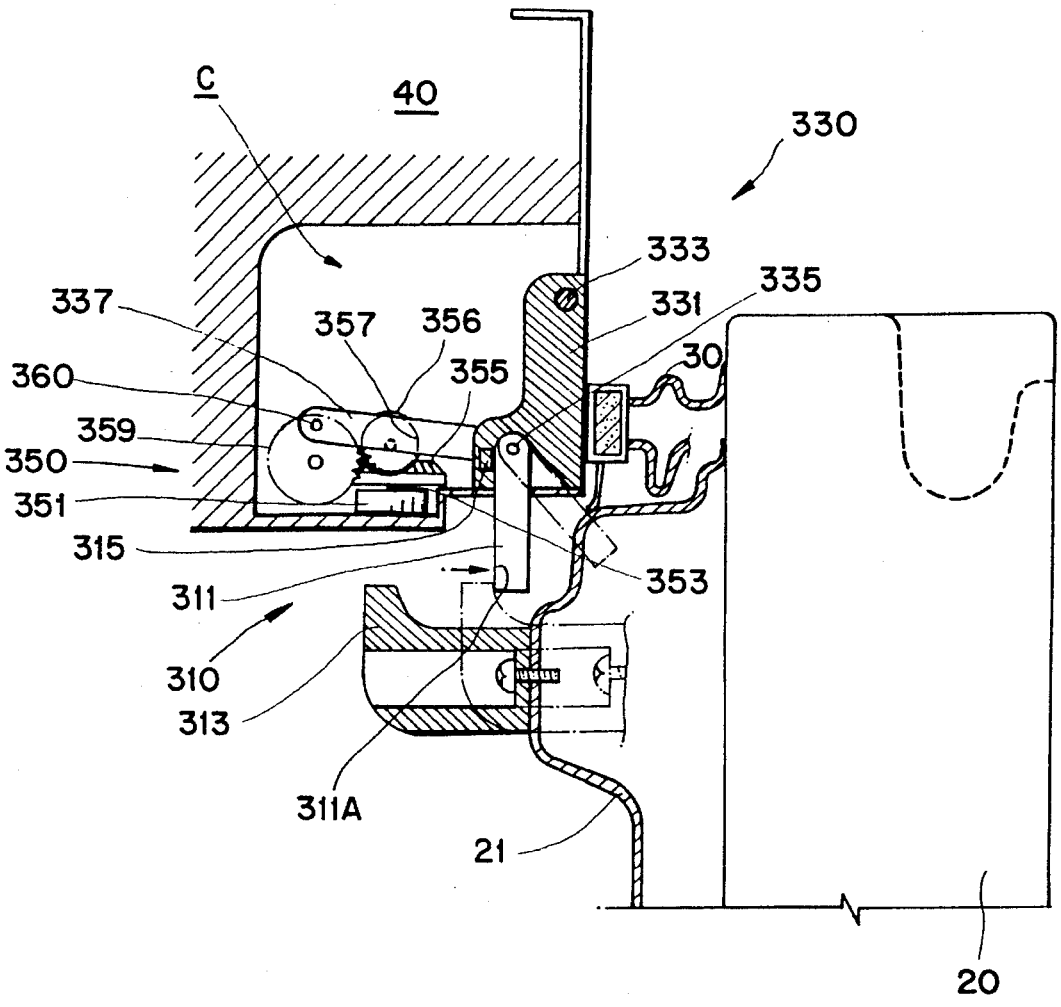
FIG. 8 is an enlarged plane view, partially cut away, of a pressure equilibrium apparatus with door closed according to a second embodiment of the present invention.
Figure 9:
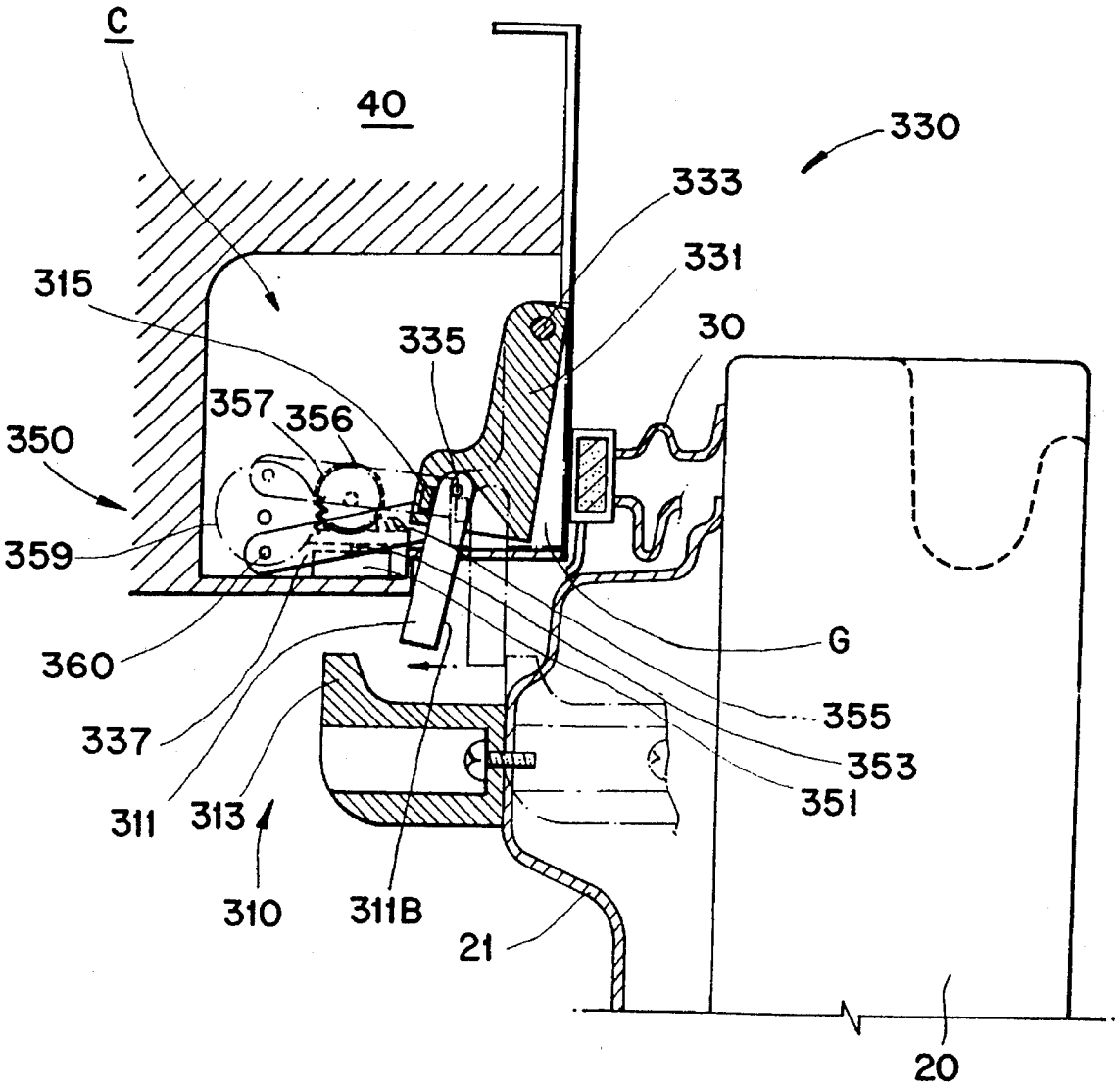
FIG. 9 is an enlarged plane view, partially cut away, of a pressure equilibrium apparatus with door opened according to a second embodiment of the present invention.
Figure 10:
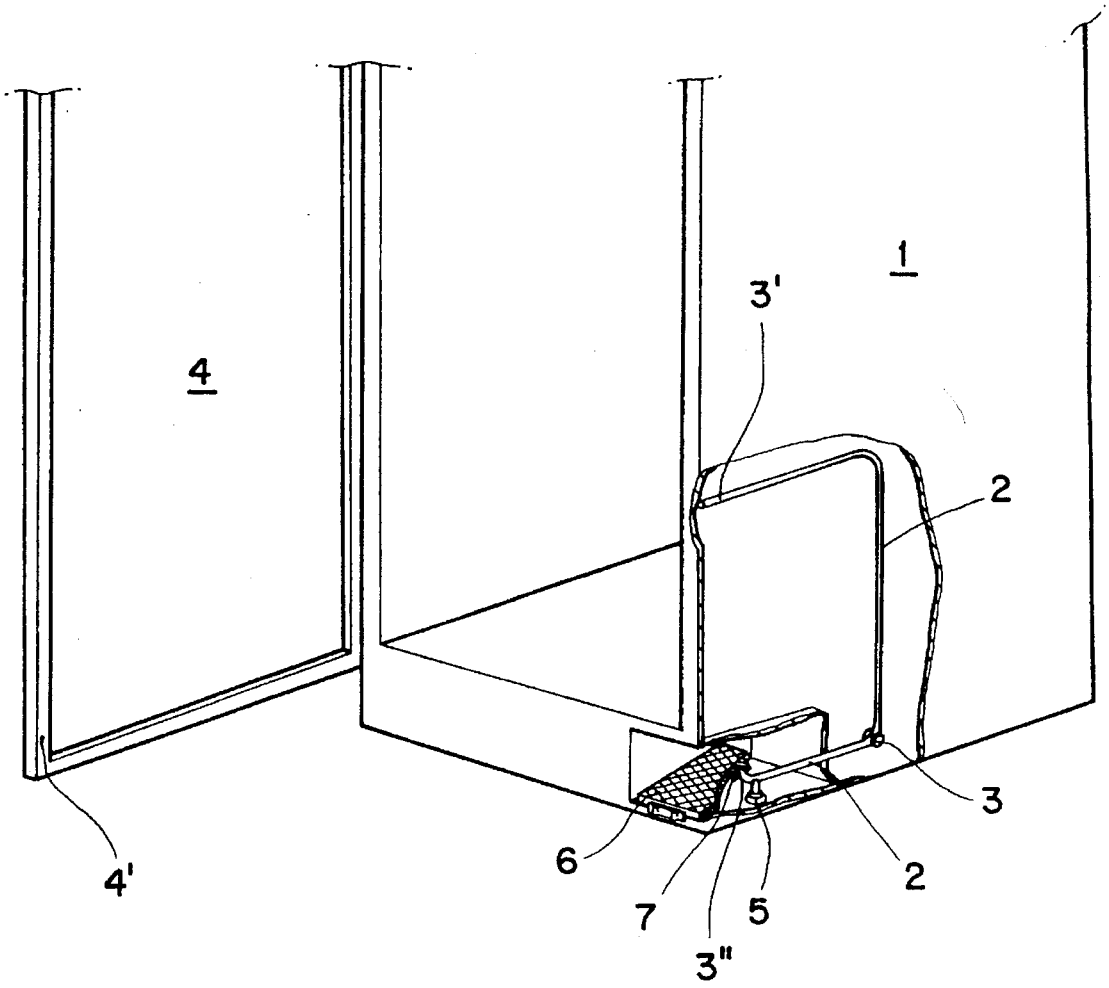
FIG. 10 (PRIOR ART)
FIG. 10 is an enlarged cut away perspective view of the door opening apparatus according to a conventional art.

A third embodiment of the present invention will be described in connection with FIGS. 8 and 9. FIGS. 8 and 9 show the operating state of a pressure equilibrium apparatus C. The same parts as that of the first embodiment are designated by the same numerals but the detailed description of those parts will be omitted. The pressure equilibrium apparatus C is provided at the front of the intermediate partition 40 facing the gasket 30.

The pressure equilibrium apparatus C comprises (a) a transmitting means 310 for transmitting energy generated from the opening of the door 20 (b), an air inflowing means 330 for guiding the flow of the outside air into the inside of the refrigerator, and (c) a releasing means 350 for releasing the stored energy transmitted by the transmitting means 310.

The transmitting means 310 comprises a trigger 313 protruding from a shelf 21 provided on the inner wall of the door 20, a rod 311 connected hingedly to a hinge pin 335 of the air inflowing means 330 described later, and a stop lug 315 mounted on the side wall of a closure plate 331 of the air inflowing means 330 described later. In the arrangement of the rod 311 and the stop lug 315, when the door 20 is opened ( moving in the right direction in FIG. 8 ), the tip of the trigger 313 moves into contact with the non-hinged, that is, the lower, portion 311A of the rod 311. Since the rod 311 has a certain length and the upper portion of the rod 311 is hinged, the trigger 313 moves continually in the right direction and eventually the lower portion of the rod 311 moves back down to its free state by its own weight. When the door 20 is closed, the tip of the trigger 313 pushes the lower portion 311B of the rod 311 ( moving in the left direction in FIG. 9 ). To limit the swinging motion of the rod 311 the stop lug 315 is installed.

The air inflowing means 330 is installed at the front of the intermediate partition 40 facing the gasket 30. The air inflowing means 330 comprises an air closure member 331 connected hingedly to the intermediate partition 40 by a hinge pin 333 provided at the upper portion of the air closure member 331. The air inflowing means 330 further comprises a rod 337 one end of which is connected to the hinge pin 335 of the air closure member 331 and a pin 360 of the releasing means 350 described later is connected hingedly at the other end of rod 337.

The releasing means 350 comprises a gear train 357,359 connected to the rod 337, a spiral torsion spring 351 providing a shaft 353 for storing/releasing energy, and a pair of bevel gears 355,356 connected to the gear train 357,359 and the spiral torsion spring 351, respectively. The gear 359 has a larger number of teeth than the gear 357 and has a pin 360 connected to the rod 337. The gear 357 having the smaller number of teeth is arranged to mesh with the gear 359. The gear 357 is coaxial with the second bevel gear 356, and the first bevel gear 355 is arranged perpendicular to the second bevel gear 356. The shaft 353 of the first bevel gear 355 is connected to one end of the spiral torsion spring 351, and another end of the spiral torsion spring 351 is fixed to a cover (not shown). Therefore, the motion of the rod 337 is transmitted from the gear 359 with a larger number of teeth to the gear 357 with a smaller number of teeth such that the gear 357 has a faster speed. Energy absorbed by the spiral torsion spring 351 is transmitted from the gear 357 to the gear 359 such that the gear 359 has a slower speed.

The pressure equilibrium apparatus of the refrigerator built as described above is activated as follows. In FIG. 8, when the door 20 is opened, the tip of the trigger 313 makes the rod 311 swing around the hinge pin 35 without interrupting the opening of the door 20. During the closure of the door 20 shown in FIG. 9, the tip of the trigger 313 pushes the rod 311, and the closure plate 331 moves hingedly around the first hinge pin 333.

When the plate 331 is swung, a space or passage G is formed between the shut-down plate 331 and the gasket 30. Through the space G the outside air flows into the inside of the refrigerator. The swinging motion of the shut-down plate 331 moves the rod 337 connected to the releasing means 350 in the left direction, whereby the pin 360 of the gear 359 turns around the center shaft of the gear 359. The turning of the pin 360 causes the gear 359 to be driven which in turn drives the gear 357. The driving of the gear 357 is utilized to wind the spiral torsion spring 351 through the bevel gears 356,355. The wound spring possesses the energy generated by.

After the trigger 313 disengages from the rod 311, the resilient force of the torsion spring 351 is transmitted to the rod 337 through bevel gears 355,356 and the gear train 357,359. The resulting right direction movement of the rod 337 causes the shut-down plate 331 to contact the gasket 30. The air inflowing passage G formed between the gasket 30 and the shutdown plate 331 is thus gradually closed. During the predetermined time lag, the air inflowing passage G remains opened. As the outside air flows to the inside of the cabinet through the air inflowing passage G, due to the pressure difference generated after closing the door, the pressure inside and outside inside of the cabinet becomes equalized thereby making easy to subsequently open the door.

What is claimed is:

1. A refrigerator, comprising:

a body forming a refrigeration compartment;

a door hinged to said body for opening and closing said compartment; and a pressure equalizing mechanism for creating a substantial equalization of pressures inside and outside of said compartment to facilitate a subsequent opening of said door, comprising:

passage-forming means forming a passage communicating said compartment with ambient air outside of said compartment following a closing of said door, and closing means for automatically closing said passage after a predetermined time period following the closing of said door for achieving said substantial equalization of pressures.

2. The refrigerator according to claim 1, wherein said passage-forming means comprises means forming said passage in response to an opening movement of said door.

3. The refrigerator according to claim 2, wherein said closing means includes energy-storing means for storing energy produced by the opening movement of said door for closing said passage after said predetermined time period.

4. The refrigerator according to claim 3, wherein said energy storing means releases stored energy in response to the closing of said door, said closing means further including restricting means restricting the release of said energy during said predetermined time period.

5. The refrigerator according to claim 4, wherein said energy storing means comprises a compressible fluid, said closing means including a piston connected to said door for being moved into a fluid-compressing state in response to the opening movement of said door, said restricting means comprising an aperture wall through which the compressed fluid flows when said door is closed.

6. The refrigerator according to claim 5, wherein said wall divides a first chamber from a second chamber, said piston being movable in said first chamber, said wall including a first aperture having a valve operable in response to movement of said piston in a fluid-compressing direction to admit travel of compressed fluid into said second chamber, said wall including a second aperture admitting travel of fluid from said second chamber to said first chamber during closing of said door for pushing said piston to a passage-closing position.

7. The refrigerator according to claim 6, wherein said door is mounted to said cabinet by a hinge pin which rotates when said door swings open and closed, a cable having one end mounted on said hinge prior for being wound thereon and unwound therefrom, another end of said cable being connected to said piston for pulling said piston in a fluid-compressing direction as said door is being opened.

8. The refrigerator according to claim 1, wherein said closing means includes energy storing means for storing energy produced by an opening movement of said door for closing said passage after said predetermined time period.

9. The refrigerator according to claim 1, wherein said passage-forming means comprises means forming said opening in response to a closing movement of said door.

10. The refrigerator according to claim 9, wherein said wall comprises a part of a piston, said wall including a spherical seat having an aperture extending through said piston, said plunger including a ball mounted in said spherical seat for opening said aperture while said plunger is pulled outwardly and for covering said aperture when said plunger is pushed inwardly by said gasket after said door is closed, said piston forming another aperture for enabling air to flow past said piston when said plunger is moved to its inward position.

11. The refrigerator according to claim 9, wherein said closing means includes energy-storing means for storing energy produced by a closing movement of said door for closing said passage at the end of said predetermined time period.

12. The refrigerator according to claim 11, wherein said energy-storing means comprises a resilient member.

13. The refrigerator according to claim 12, wherein said resilient member comprises a sealing gasket mounted on said door, said passage-forming means comprising a movable member mounted to said cabinet for movement between outward and inward positions; when in said outward position, said movable member contacts said gasket upon closing of said door for compressing said gasket to form said passage; said passage opening means further comprising restricting means for restricting movement of said movable member to said inward position under the action of said gasket to create said predetermined time period.

14. The refrigerator according to claim 13, wherein said movable member comprises a plunger, said restricting means comprising an aperture wall connected to said plunger.

15. The refrigerator according to claim 14, wherein said plunger is magnetically attracted to a plate mounted in said gasket so that said plunger is pulled to said outward position in response to opening of said door.

16. The refrigerator according to claim 12, wherein said passage-opening means comprises a movable member arranged to be displaced from a first position to a second position by said door when said door is closed, said movable member creating said passage when in said second position, said resilient-member comprising a spring operably connected to said movable member to be displaced thereby to an energy-storing position when said movable member is moved to first position, said spring biasing said movable member to said first position, said closing means further comprising restricting means for restricting release of stored energy of said spring to create said time period.

17. The refrigerator according to claim 16, wherein said restricting means comprises a gear train for transmitting force from said movable member to said spring at a first speed, and transmitting force from said spring to said movable member at a second speed slower than said first speed.

18. The refrigerator according to claim 17, wherein said spring comprises a tension spring.

19. The refrigerator according to claim 18, wherein said closing means includes energy-storing means for storing energy produced by a closing movement of said door for closing said passage after said predetermined time period.

20. A method of substantially equalizing pressures inside and outside of a refrigerator to facilitate a subsequent opening of a door of said refrigerator, comprising the steps of:

A) providing a passage communicating the interior of said refrigerator with an outside of said refrigerator upon a closing of said door, to enable inside and outside pressures to be substantially equalized, and B) automatically closing said passage after a predetermined time period following the closing of said door.

* * * * *